US005108316A

United States Patent [19]

Yamada et al.

[11] Patent Number: 5,108,316

[45] Date of Patent: Apr. 28, 1992

[54] MULTI-PIN ELECTRICAL CONNECTOR OF LOW INSERTION FORCE TYPE

[75] Inventors: Shoji Yamada, Tokyo; Masami Sasao, Kawasaki; Yoshihisa Yamamoto, Yamato, all of Japan

[73] Assignee: Molex Incorporated, Lisle, Ill.

[21] Appl. No.: 389,393

[22] Filed: Aug. 4, 1989

[30] Foreign Application Priority Data

Aug. 4, 1988 [JP] Japan ..... 63-103658

[51] Int. Cl.[5] ..... H01R 17/00

[52] U.S. Cl. ..... 439/660; 439/692

[58] Field of Search ..... 439/851-857, 439/55, 884, 659, 660, 655, 692, 693

[56] References Cited

U.S. PATENT DOCUMENTS 4,363,529 12/1982 Loose ..... 439/82
4,491,376 1/1985 Gladd et al. ..... 439/660
4,583,807 4/1986 Kaufman et al. ..... 439/79
4,639,056 1/1987 Lindeman et al. ..... 439/79
4,679,890 7/1987 Fineblum ..... 439/884

*Primary Examiner*—David L. Pirlot
*Attorney, Agent, or Firm*—Stephen Z. Weiss

[57] ABSTRACT

Disclosed is a multi-pin electrical connector of low insertion force type comprising a male plug having pin terminals of two different kinds, and a female socket having contacts of same kind. Each pin terminal of one kind has a straight inclination extending downwards from its tip end at a relatively small angle whereas each pin terminal of the other kind has a straight inclination extending downwards from its tip end at a relatively large angle. Thus, the resultant insertion force of pin terminals of one kind reaches its peak value earlier than the resultant insertion force of pin terminals of the other kind reaches its peak value while the male plug is inserted in the female socket. To an advantage the straight inclination can be easily shaped with precision. This permits mass production of pin terminals of same insertion force characteristics.

5 Claims, 9 Drawing Sheets

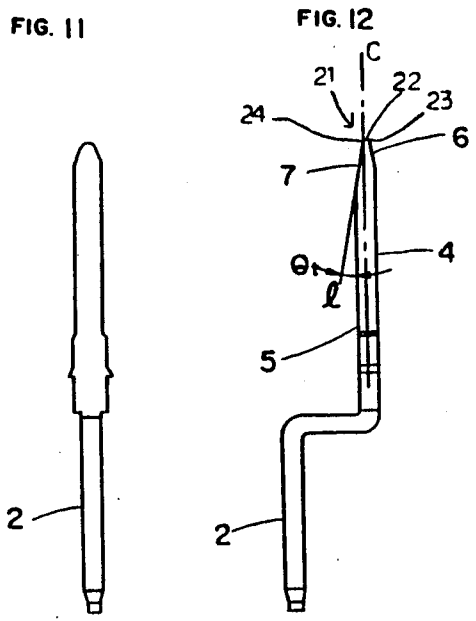
FIG. 12
C
21
22
23
6
24
7
4
θ
ℓ
5
2
FIG. 11
2
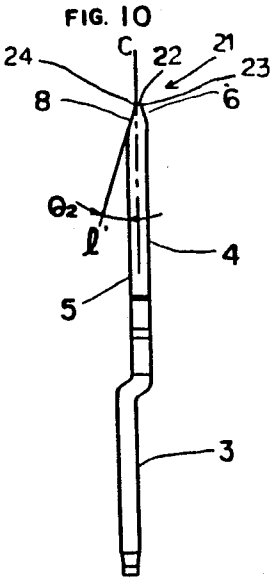
FIG. 10
C
21
22
23
6
24
8
4
θ2
ℓ'
5
3
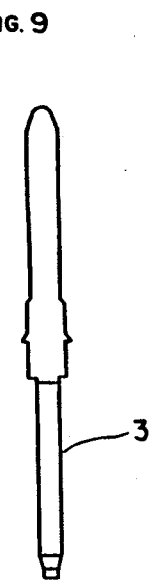
FIG. 9
3
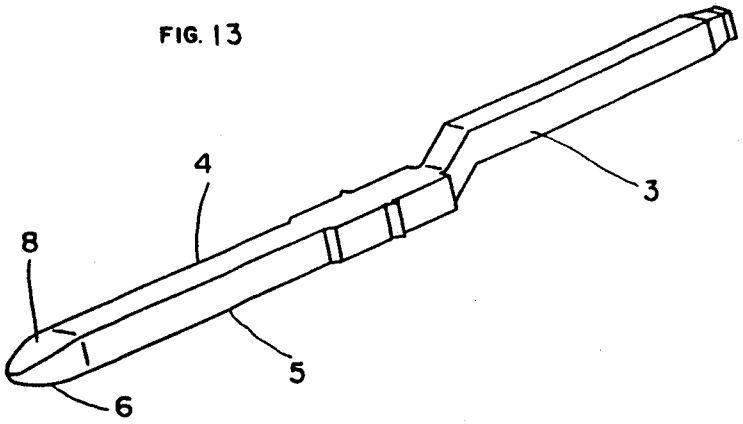
FIG. 13
3
4
5
6
8

S3
F1
F0
S1
S2
INSERTION FORCE
INSERTION DEPTH

2F1

F1
F0
INSERTION FORCE
INSERTION DEPTH

MULTI-PIN ELECTRICAL CONNECTOR OF LOW INSERTION FORCE TYPE

BACKGROUND OF THE INVENTION

1. Field of the Invention

The present invention relates to an electric connector, and particularly to a multi-pin electrical connector of low insertion force type which permits reduction of the force which is required in inserting its male plug in its female socket.

2. Description of the Prior Art

As is well known, a variety of multi-pin electrical connectors have been proposed and practically used. Such an electrical connector comprises a male plug having a plurality of pin terminals each having a tapering tip, and a female socket having a plurality of contacts each adapted to make a resilient contact with the tapering tip-and-consecutive flat side of a corresponding pin terminal. At an early stage of development all pin terminals have one and same inclination angle at its tapering tip.

FIG. 26 shows the insertion force-to-insertion depth characteristics of a pin terminal when inserted in a counter contact. As seen from the graph, the insertion force rises with the increase of the insertion depth, and it will reach its peak value when the pin terminal comes close to its final contact position, and accordingly the intervening angle between the tapering tip of the pin terminal and the contact surface decreases. When the intervening angle reduces to zero, the insertion force levels off as indicated at $F_0$. The peak value is indicated at $F_1$ in the graph, and sometimes the force of the peak value is called "insertion force". Here, it should be noted that all pin terminals in the socket reach their final positions simultaneously, a multiplied.

As a result, the resultant insertion force required for inserting the male plug into the female socket is equal to a multiplication of the insertion force of a single pin terminal by the number of the pin terminals used in the socket. The graph shows the resultant insertion force 2 $F_2$ of two pin terminals compared with that required for insertion of a single pin terminal into a counter contact.

This shows the multiplied increase of insertion force required in a multi pin electrical connector. There was a strong demand for decreasing the insertion force required in a multi pin electrical connector. In an attempt to meet such a demand a variety of multi pin connectors were proposed, and are actually used. For instance, U.S. Pat. No. 4,679,890 shows a multi pin electrical connector of low insertion force type. It has a plurality of contacts each having a shape symmetrical with respect to its center axis, and a plurality of pin terminals each having different curvatures on its opposite sides with respect to its center axis. This arrangement caused the insertion force of the pin terminal to reach twice at different times because one curvature comes to contact with the counter contact earlier than the other curvature.

This principle may be applied to an electrical connector whose pin terminals are so designed that each pin terminal contacts a counter female contact on its one side. In this case at least two kinds of pin terminals are prepared, and one kind of pin terminal has a first curvature on its contact side whereas the other kind of pin terminal has a second curvature on its contact side. These first and second curvatures are different from each other, hence causing insertion of forces to appear at different times, thereby substantially decreasing the resultant insertion force compared with use of only one kind of tapering pin terminals, which would cause simultaneous increase of insertion forces, requiring a multiplied resultant insertion force.

Pin terminals are punched from a piece of metal plate, and then their tapering tips are trimed to precise desired curvature. To a disadvantage, however, it is very difficult to shape the tapering tip of a pin terminal into a precise curved shape. It is likely that pin terminals have less precise curvatures, and this is a cause for failure in decreasing the resultant insertion force to a desired small value. In other words, the extreme precision is required in making pin terminals of different kinds to attain the satisfactory result.

SUMMARY OF THE INVENTION

One object of the present invention is to provide a multi-pin electrical connector which makes it easy to give a pin terminal as precise shape as desired, thus assuring the substantial reduction of the resultant insertion force.

To attain this object a multi-pin electrical connector of low insertion force type comprising a plug having a plurality of pin terminals, and a socket having a plurality of contacts, each being adapted to come into resilient contact with a corresponding pin terminal when said plug is inserted in said socket, said plurality of pin terminals being of at least two groups of such different terminal tip shapes that may cause the resultant insertion force of one group of pin terminals to reach its peak value at a time different from when the resultant insertion force of the other group of pin terminals reaches its peak value while said plug is inserted in said socket, is improved according to the present invention in that each pin terminal of said one or the other group has a straight inclination extending from its tip end and a consecutive flat surface parallel to its center axis to provide together a contact surface with which a corresponding contact in said socket may come into resilient contact, the inclination angle of the straight inclination each of the pin terminals of said one group being different from that of the pin terminals of said the other group, thereby causing the resultant insertion force of said one group to reach its peak value at a time different from when the resultant insertion force of said the other group reaches its peak value while said plug is inserted in said socket.

According to one embodiment of the present invention the tip of each pin terminal has a first inclination extending downward from the tip end to one side of the pin terminal and a second inclination extending downward from the tip end to the other side of the pin terminal, said first and second inclinations having a same angle, but the tapering tip end being beyond the central axis, thus arranging said first and second inclinations asymmetrical with respect to the central axis, and the inclination angle of said second inclination of each pin terminal of said one group being different from the inclination angle of said second inclination of each pin terminal of said the other group.

According to another embodiment of the present invention said pin terminals of said one and the other group are alternately arranged in same rows and same lines in said plug.

According to still another embodiment of the present invention said pin terminals of said one and the other group are alternately arranged in each line, but same kind of pin terminals are arranged in each row.

According to still another embodiment of the present invention said pin terminals of said one and the other group are alternately arranged in each row, but same kind of pin terminals are arranged in each line.

As described above, a multi-pin electrical connector uses a plurality of pin terminals of at least two different kinds. Specifically one kind of pin terminals have a relatively small inclination angle whereas the other kind of pin terminals have a relatively large inclination angle. When the male plug is inserted into the female socket, the resultant insertion force of said the other kind of pin terminals reach its peak value earlier than the resultant insertion force of said one kind of pin terminal reaches its peak value. Thus, insertion of the male plug into the female socket requires a decreased insertion force, compared with that which would be required in inserting one and same kind of pin terminals into corresponding contacts.

To an advantage, the straight inclination can be easily shaped in a pin terminal body with precision, compared with the curved surface which is given to the tip of a conventional pin terminal. Also, necessary punching dies to give a straight inclination to a pin terminal body can be easily designed and can be made with precision. Thus, pin terminals of different precise inclination angles can be easily prepared, and accordingly a lot of multi-pin electrical connectors having exactly same insertion force characteristics can be provided.

Other objects and advantages of the present invention will be better understood from the following description of a preferred embodiment of the present invention, which is shown in accompanying drawings:

FIGS. 1 to 13 show a male plug of a multi-pin electrical connector according to one embodiment of the present invention:

FIG. 1 is a front view of the male plug;

FIG. 2 is a plane view of the male plug;

FIG. 3 is a rear view of the male plug;

FIG. 4 is a side view of the male plug as seen from the right in FIG. 2;

FIG. 5 is a section of the male plug taken along the line B—B in FIG. 2;

FIG. 6 is a section of the male plug taken along the line A—A in FIG. 2;

FIG. 7 is an enlarged front view of a fragment of the male plug;

FIG. 8 is an enlarged rear view of a fragment of the male plug;

FIG. 9 is a front view of a pin terminal having a second straight side inclined at a relatively large angle with respect to its center axis;

FIG. 10 is a side view of the pin terminal of FIG. 9;

FIG. 11 is a front view of a pin terminal having a straight side inclined at a relatively small angle with respect to its center axis;

FIG. 12 is a side view of the pin terminal of FIG. 11;

FIG. 13 is a perspective view of a pin terminal.

FIG. 14 is a front view of the female socket;

FIG. 15 is a plane view of the female socket;

FIG. 16 is a rear view of the female socket;

FIG. 17 is a side view of the female socket as seen from the right in FIG. 15;

FIG. 18 is a section of the female socket taken along the line B—B in FIG. 15;

FIG. 19 is a section of the female socket taken along the line A—A in FIG. 15;

FIG. 20 is an enlarged front view of a fragment of the female socket;

FIG. 21 is an enlarged rear view of a fragment of the female socket;

FIG. 22 is a perspective view of a contact;

Figure 24:
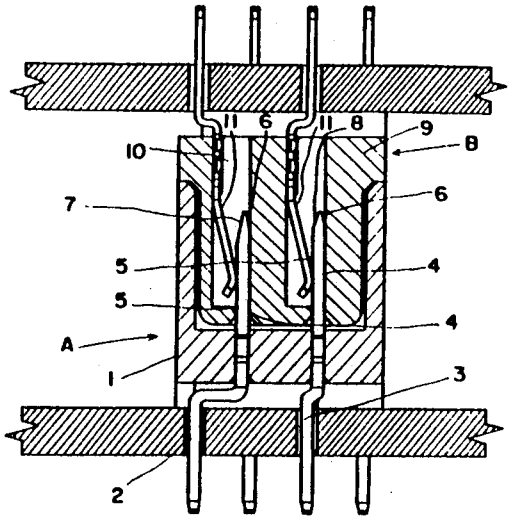
FIG. 24 is a section of the male plug (FIG. 6) and the female socket (FIG. 19) mated together.
Figure 23:
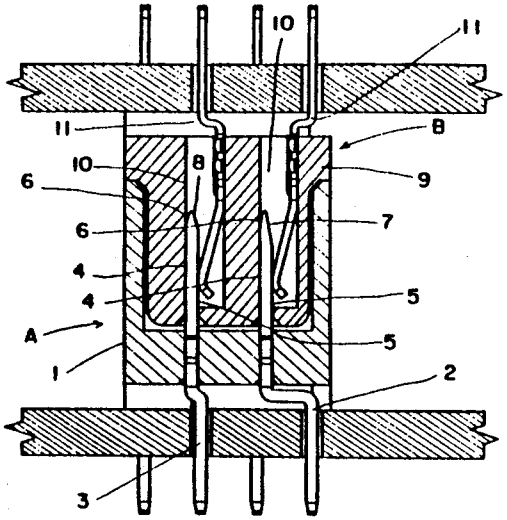
FIG. 23 is a section of the male plug (FIG. 5) and the female socket (FIG. 18) mated together.
Figure 22:
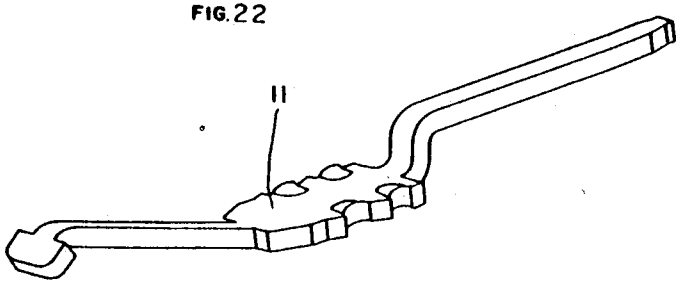
Figure 25:
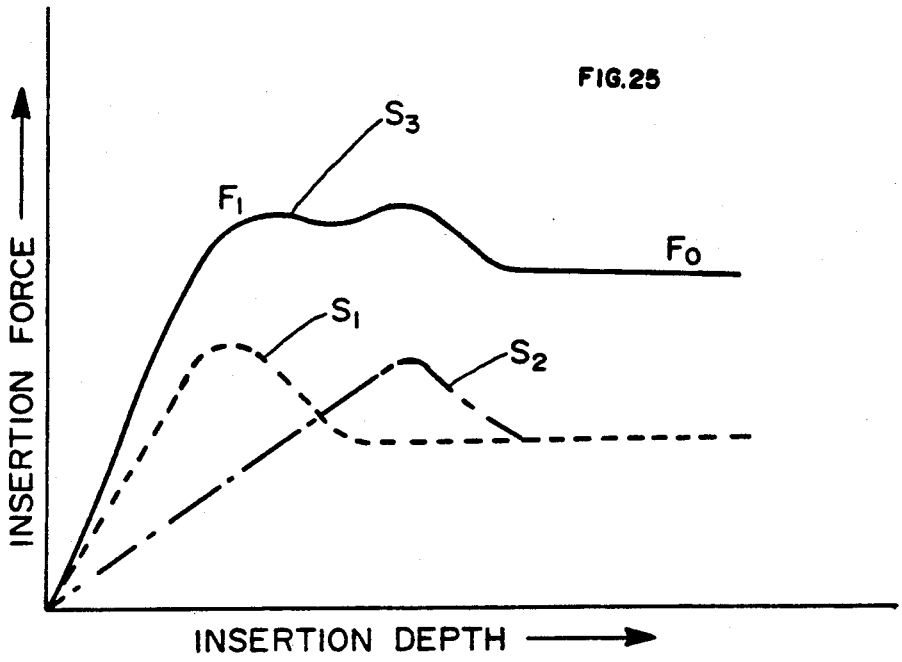
FIG. 25 is a graph showing the insertion force-to-insertion depth characteristics of a multi-pin electrical connector of low insertion force type according to the present invention.
Figure 26:
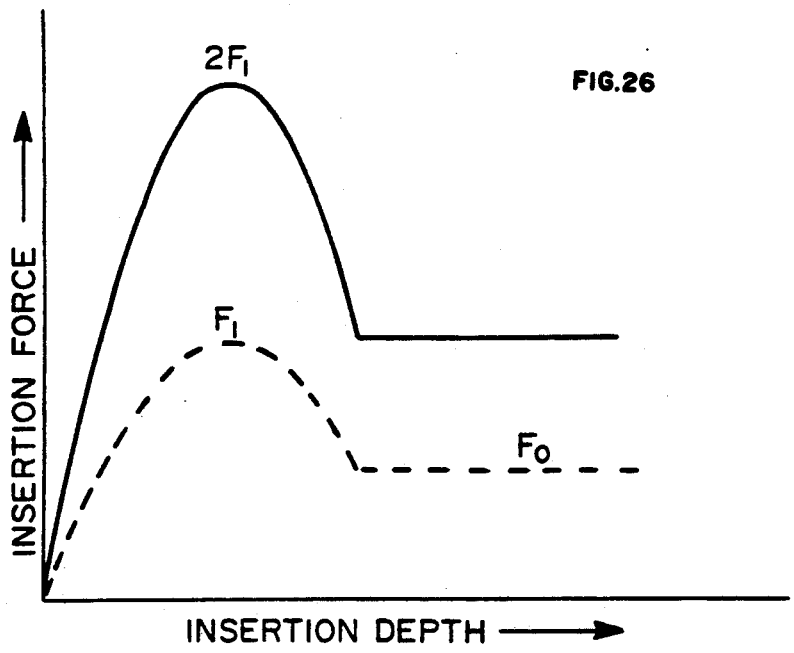
FIG. 26 is a graph showing the insertion force-to-insertion depth characteristics of a conventional multi-pin electrical connector.

Referring to FIGS. 1 to 25, FIGS. 1 to 13 show the male plug of a multi-pin electrical connector of low insertion force type according to one embodiment of the present invention; FIGS. 14 to 22 show the female socket of the multi-pin electrical connector; FIGS. 23 and 24 show how the pin terminals of the male plug are inserted in the contacts of the female socket of the multi-pin electrical connector; and finally FIG. 25 shows the insertion force-to-insertion depth characteristics of the multi-pin electrical connector.

First, referring to FIGS. 1 to 13, the male plug A comprises a plug housing 1, a plurality of pin terminals 2 of one kind, and a plurality of pin terminals 3 of the other kind. In this particular embodiment the plug housing 1 has 30 pin terminals in its upper line X and 30 pin terminals in its lower line Y. Each pin terminal has a tapering tip and consecutive opposite sides 4 and 5 parallel to its center axis. The tapering tip of the pin terminal has opposite straight or flat surface inclinations. One inclination is indicated at 6 in the pin terminal 2 or 3 of one or the other kind, and the other inclination is indicated at 7 in the pin terminal 2 of one kind, and is indicated at 8 in the pin terminal 3 of the other kind.

In this particular embodiment only the inclinations of the pin terminals of the male plug may come into resilient contact with the contacts of a female socket, as later described. The inclination angle $\theta_1$ of the straight inclination 7 (that is, the angle formed between the line of extension 1 from the straight inclination 7 and the flat surface of one side 5) is different from the inclination angle $\theta_2$ of the straight inclination 8 (that is, the angle formed between the line of extension 1' from the straight inclination 8 and the flat surface of one side 5), as seen from FIGS. 10 and 12. For one example, the inclination angle $\theta_1$ is 10 degrees, whereas the inclination angle $\theta_2$ is 17 degrees.

As is best seen from FIG. 12, the tip 21 of the pin terminal 2 has a first inclination 6 extending downward from the tip end 23 to one side 4 of the pin terminal 2 and a second inclination 7 extending downward from the tip end 23 to the other side 5 of the pin terminal 2. The first and second inclinations 6 and 7 have a same angle with respect to the central axis C, but the tapering tip end is set apart from the central axis C. Thus, the first and second inclinations 6 and 7 are asymmetrical with respect to the central axis C. Also, as is best seen from FIG. 10, the tip 21 of each pin terminal 3 has a first inclination 6 extending downward from the tip end 23 to one side 4 of the pin terminal 3 and a second inclination 8 extending downward from the tip end 23 to the other side 5 of the pin terminal 3. The first and second inclinations 6 and 8 have a same angle with respect to the central axis C, but the tapering tip end 22 is set apart from the central axis C. Thus, the first and second inclinations 6 and 8 are asymmetrical with respect to the central axis C. Here, it should be noted that the inclination angle of the second inclination 7 of the pin terminal 2 of one kind is different from the inclination angle of the second inclination 8 of the pin terminal 3 of the other kind. To an advantage, the straight inclination facilitates the precise shaping of the tapering tip of the pin terminal, permitting mass production of pin terminals of exactly same insertion force characteristics.

Figure 1:
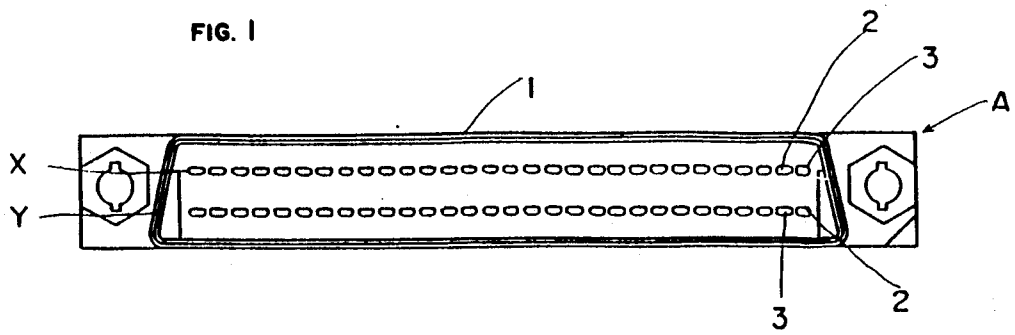
Figure 2:
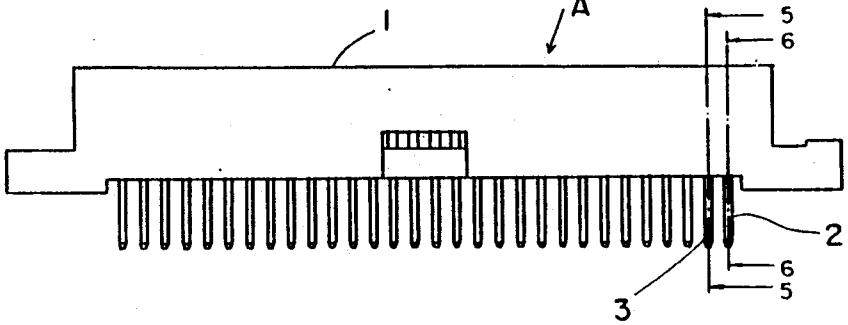
Figure 3:
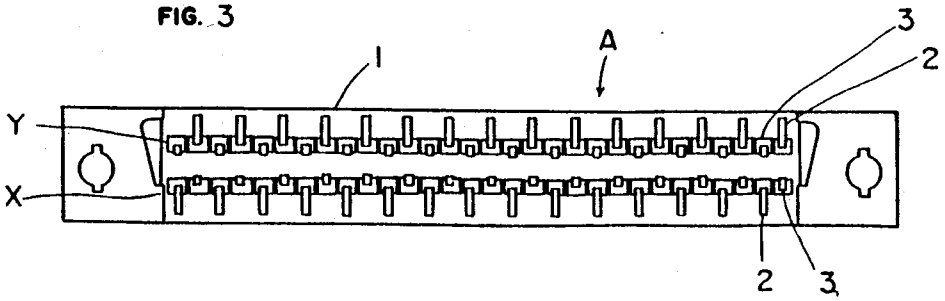
Figure 4:
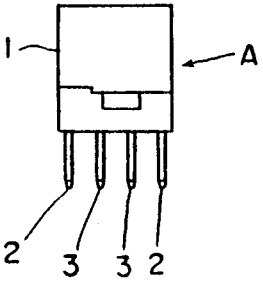
Figure 5:
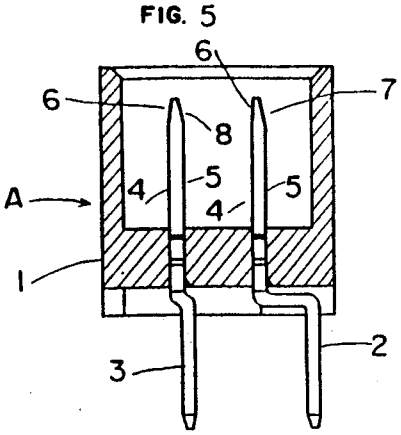
Figure 6:
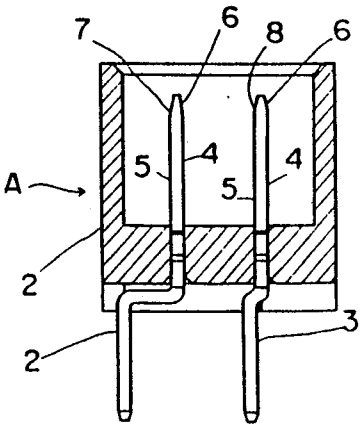
Figure 7:
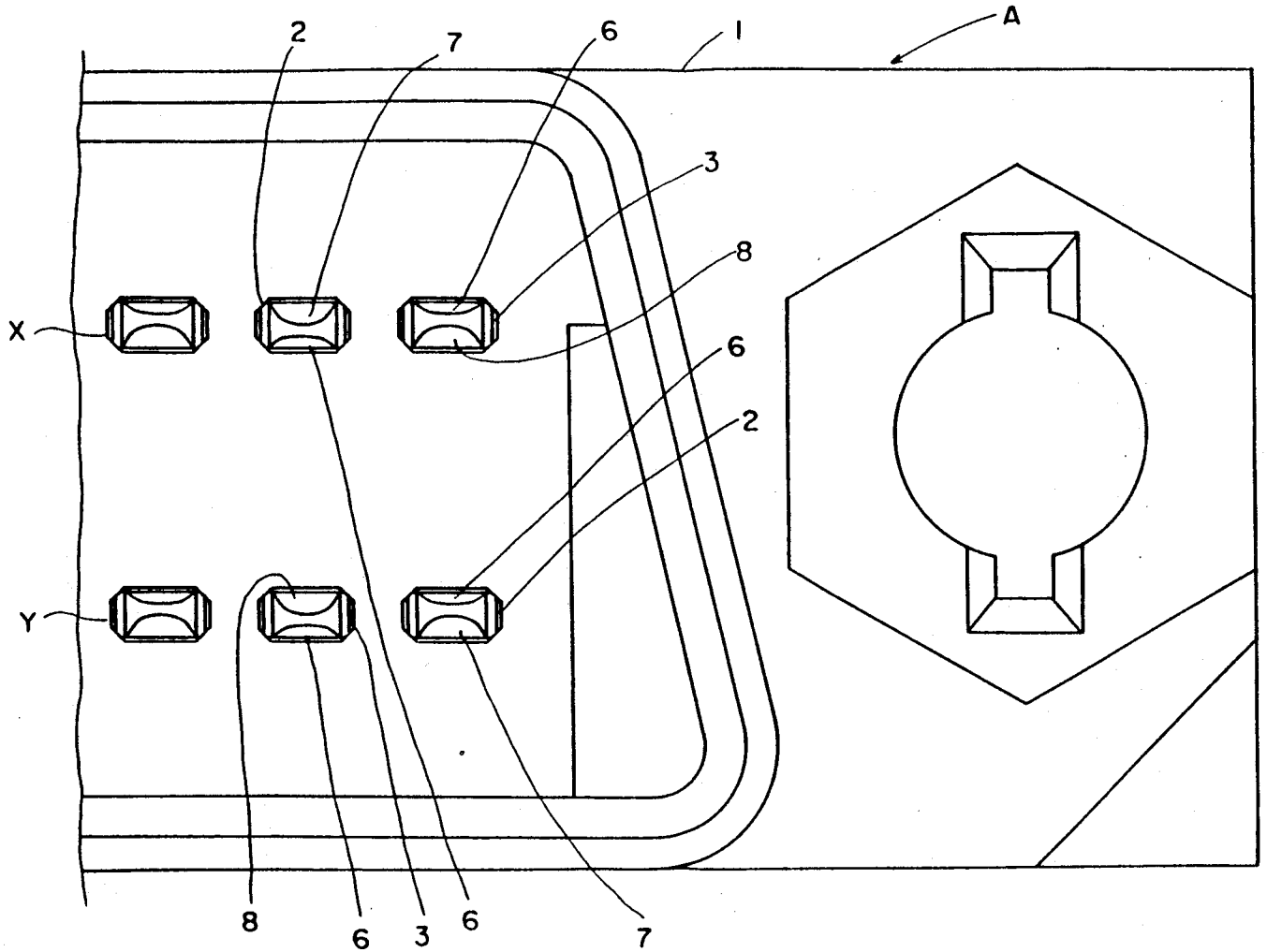
Figure 8:
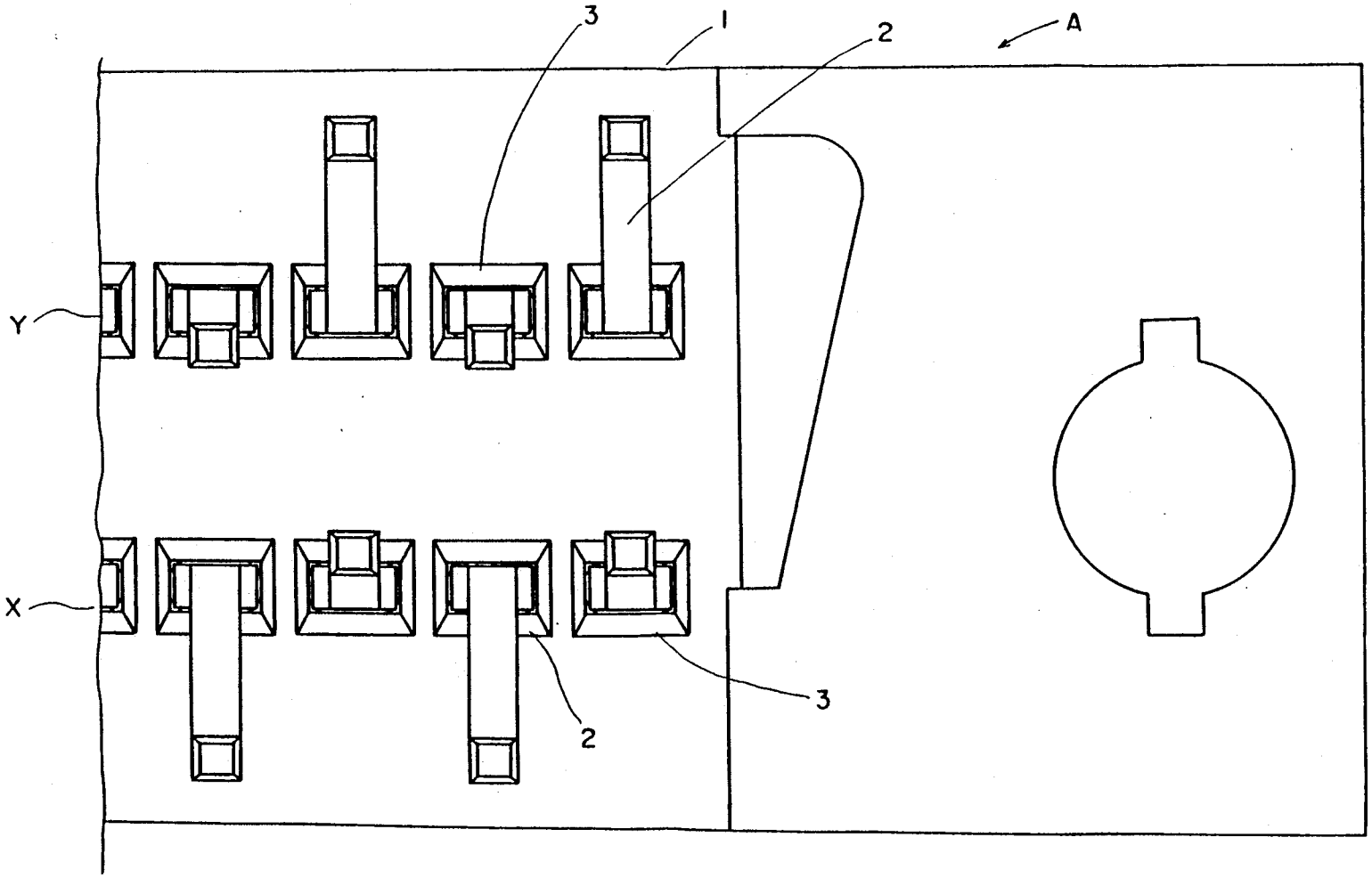
Figure 14:
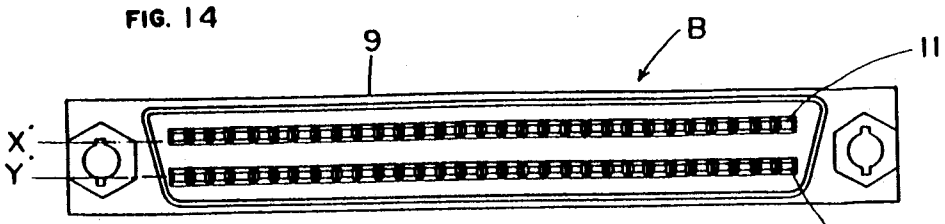
FIG. 14 to 22 show a female socket of the multi-pin electrical connector.
Figure 15:
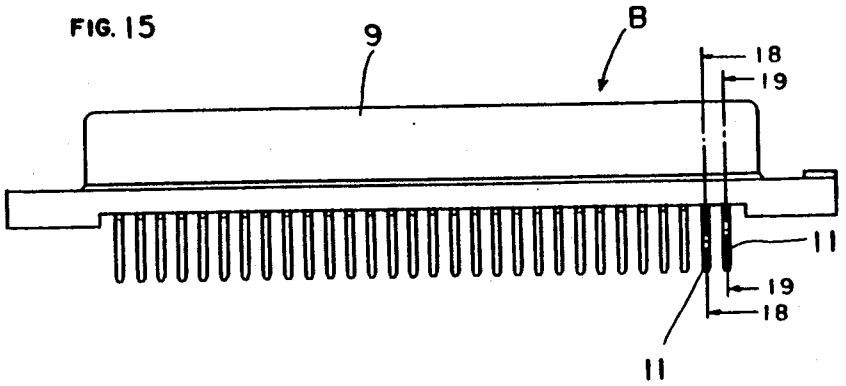
Figure 16:
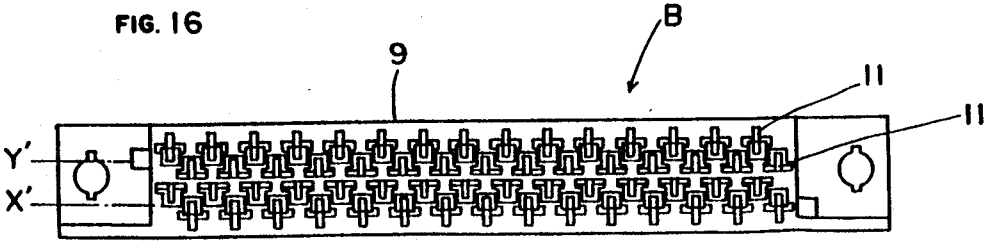
Figure 18:
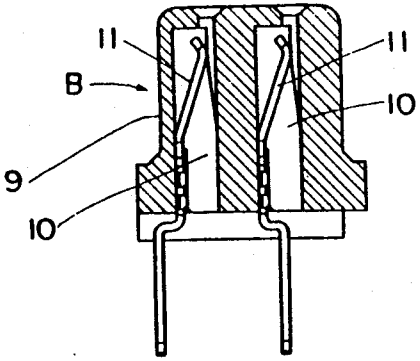
Figure 19:
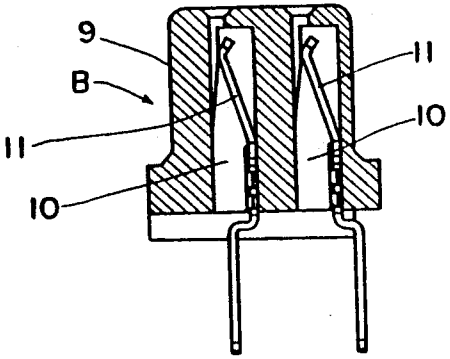
Figure 17:
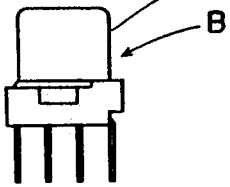
Figure 20:
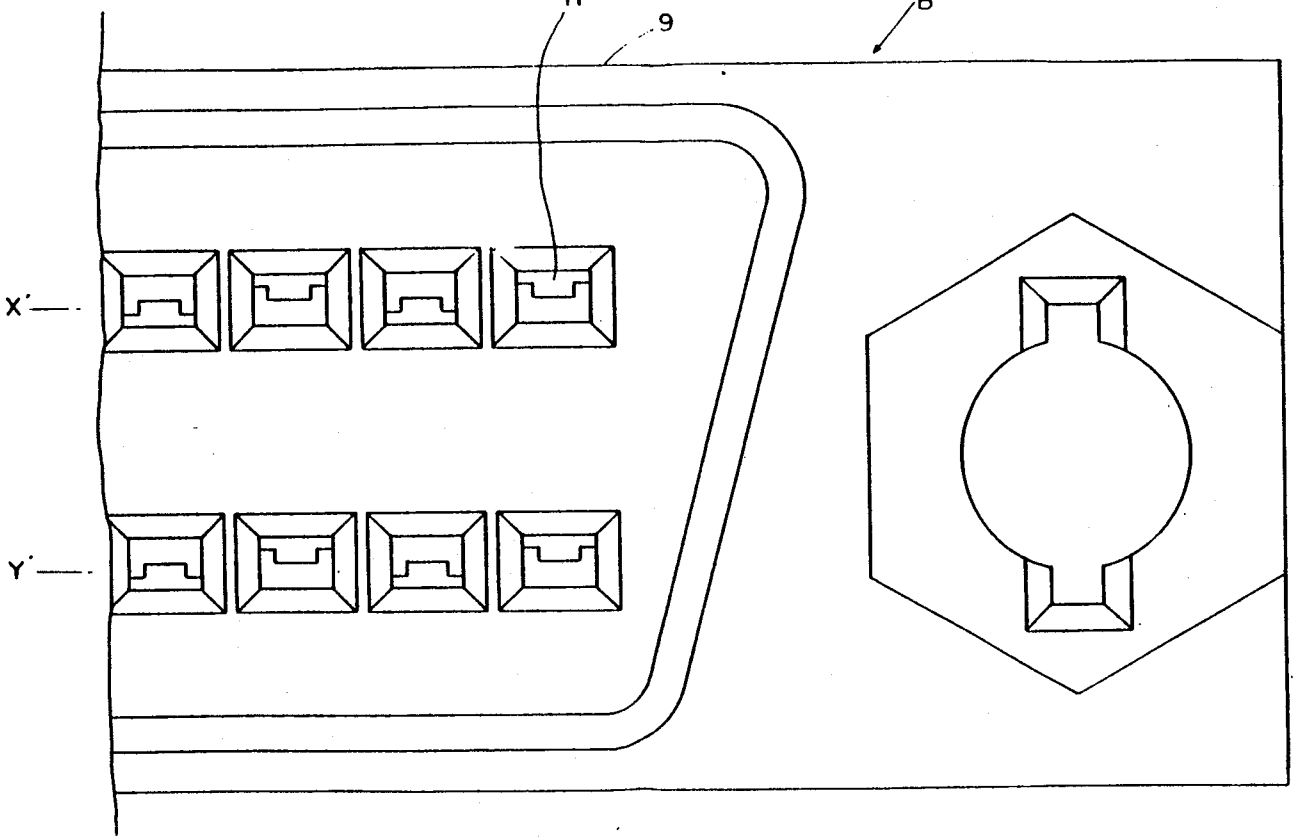
Figure 21:
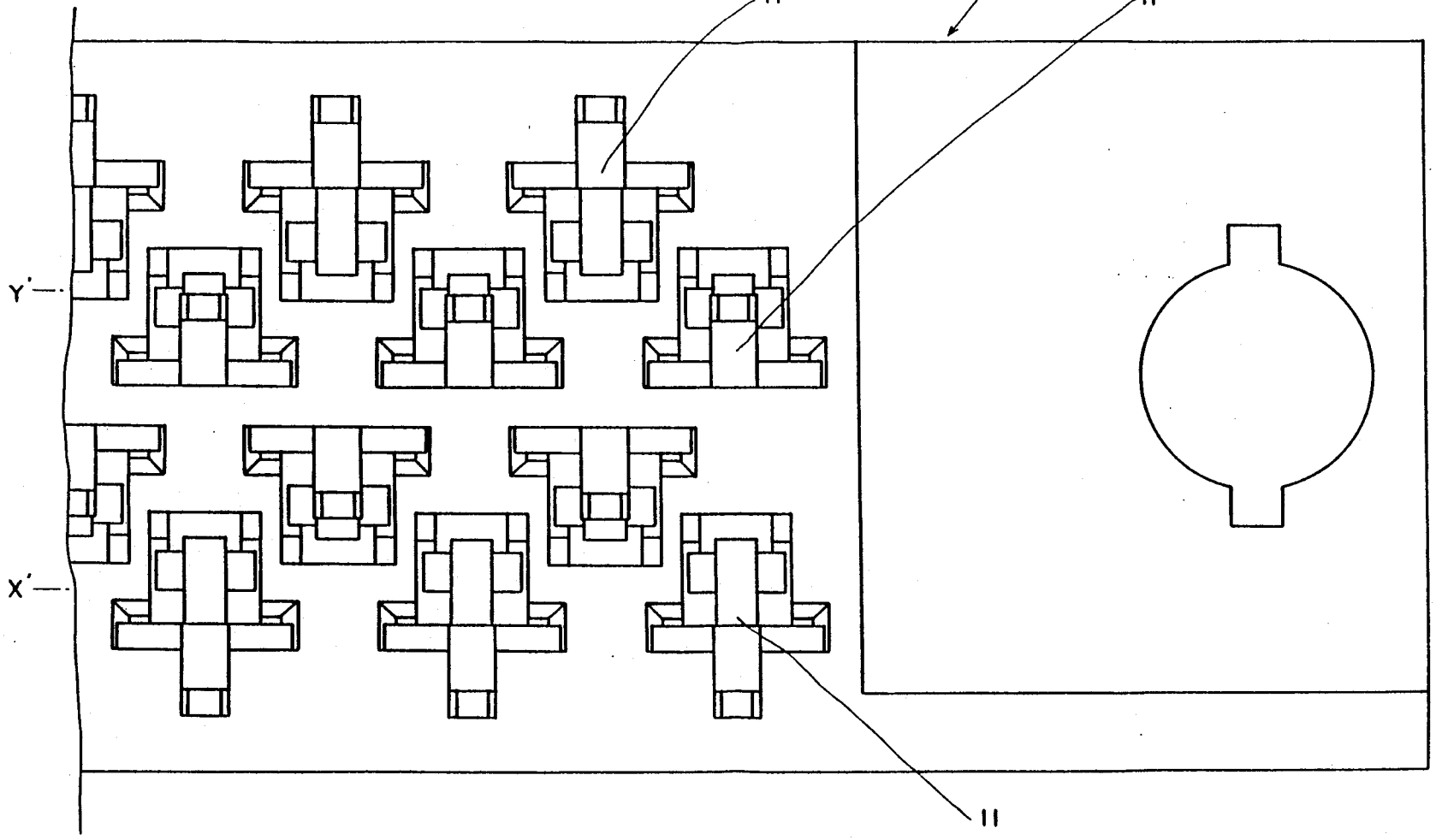

As seen from FIGS. 1 and 7, a pin terminal 2 having an inclination angle $\theta_1$ is placed at the right end of the lower line Y, and a pin terminal 3 having an inclination angle $\theta_2$ is placed on the left side of the pin terminal 2 in the same lower line Y. Pin terminals of one and the other kinds are alternately placed in the lower line Y. Likewise, a pin terminal 3 having an inclination angle $\theta_2$ is placed at the right end of the upper line X, and a pin terminal 2 having an inclination angle $\theta_1$ is placed on the left side of the pin terminal 3 in the same upper line X. Pin terminals of one and the other kinds are alternately placed in the upper line X. Thus, pin terminals 2 and 3 of one and the other kinds are placed up and down or vice versa on each row. In short, the male plug A has pin terminals 2 and 3 of one and the other kinds alternately arranged in same rows and same lines.

As is best seen from FIGS. 14 to 22, the female socket B has 30 contacts placed in the upper line X' and 30 contacts placed in the lower line Y'. These contacts have a same shape to make contact with corresponding pin terminals of one and the other kinds.

FIGS. 23 and 24 show how pin terminals 2 and 3 of different kinds are inserted in corresponding contacts 11 when the male plug A and the female plug B are mated. FIG. 23 is equivalent to a composite section of the male plug taken along the line B—B in FIG. 2 and the female socket taken along the line B—B in FIG. 15, whereas FIG. 24 is equivalent to a composite section of the male plug taken along the line A—A in FIG. 2 and the female socket taken along the line B—B in FIG. 15. As shown in these drawings, the pin terminals 2 and 3 are put in resilient contact with the contacts 11 in the cells 10 of the female socket B.

FIG. 25 shows the insertion force-to-insertion depth characteristics of the multi-pin electrical connector. In this graph the insertion force to be applied to a pin terminal having an inclination angle $\theta_1$ varies with the increase of insertion depth as indicated at $S_1$ whereas the insertion force to be applied to a pin terminal having an inclination angle $\theta_2$ varies with the increase of insertion depth as indicated $S_2$. Because of difference in inclination angles in pin terminals 2 and 3 of one and the other kinds their peak values appear at different times. Thus, the resultant curve $S_3$ show a relatively small peak value $F_1$. As already described, each pin terminal has first and second straight inclinations on opposite sides of the tapering tip of the pin terminal. These straight inclinations can be easily shaped with precision because of their simplest shape, and therefore a lot of pin terminals of exactly same insertion force characteristics can be made without difficulty. This assures that every multi-pin electrical connector causes appearance of its peak value at exactly controlled times in the course of insertion. The same result could be hardly attained with pin terminals having differennt curvatures.

As for arrangement of pin terminals which is different from the one described above with reference to FIG. 1, a pin terminal 2 having an inclination angle $\theta_1$ is placed at a given position in the lower line Y, and a pin terminal 3 having an inclination angle $\theta_2$ is placed on the same position in the upper line X. Pin terminals of one and the other kinds are alternately placed in the upper and lower lines. Thus, the pin terminals 2 and 3 of one and the other kinds are alternately arranged in each line, but same kind of pin terminals 2 or 3 are arranged in each row.

As another example of arrangement pin terminals 2 and 3 of one and the other kinds are alternately arranged in each row, but same kind of pin terminals 2 or 3 are arranged in each of upper and lower lines.

What is claimed is:

1. A multi-pin electrical connector of low insertion force type comprising a plug having a plurality of pin terminals, and a socket having a plurality of contacts (11), each being adapted to come into resilient contact with a corresponding pin terminal when said plug is inserted in said socket, said plurality of pin terminals being of at least two groups each group having a different terminal tip shape, characterized in that each pin terminal (2,3) of said one or the other group has a flat surface inclination (7,8) extending from its tip end and a consecutive flat surface (5) parallel to the center axis (C) of said pin terminal to provide together a contact surface with which a corresponding contact (11) in said socket (B) may come into resilient contact, inclination angle $\theta_1$ of said flat surface inclination (7) of one group being different from inclination angle $\theta_2$ of said flat surface inclination (8) of the other group, thereby causing the resultant insertion force of one group of pin terminals (2) to reach its peak value at a time different from when the resultant insertion force of the other group of pin terminals (3) reaches its peak value while said plug is inserted in said socket.

2. A multi-pin electrical connector of low insertion force type according to claim 1 wherein the tip (21) of each pin terminal (2,3) also having a second flat surface inclination (6) extending downward from the tip end (23) to one side (4) of the pin terminal located opposite said flat surface inclination (7,8), said flat surface inclination (7,8) and said second flat surface inclination (6) having a same angle, and intersecting the tapering tip end at different distances from the central axis (C), thus arranging said flat surface inclination (7,8) and said second flat surface inclination asymmetrical with respect to the central axis (C).

3. A multi-pin electrical connector of low insertion force type according to claim 1 wherein said pin terminals (2,3) of said one and the other group are alternately arranged in the same rows and the same lines in said plug (A).

4. A multi-pin electrical connector of low insertion force type according to claim 1 wherein said pin terminals (2,3) of said one and the other group are alternately arranged in each line, but the same kind of pin terminals (2,3) are arranged in each row.

5. A multi-pin electrical connector of low insertion force type according to claim 1 wherein said pin terminals (2,3) of said one and the other group are alternately arranged in each row, but the same kind of pin terminals (2,3) are arranged in each line.

* * * * *